US011643820B2

(12) United States Patent
Kuo

(10) Patent No.: US 11,643,820 B2
(45) Date of Patent: May 9, 2023

(54) SAFETY HANDLE DEVICE

(71) Applicant: Anthony Kuo, Taichung (TW)

(72) Inventor: Jerry Kuo-Yung Kuo, Taichung (TW)

(73) Assignee: Anthony Kuo, Taichung (TW)

( * ) Notice: Subject to any disclaimer, the term of this patent is extended or adjusted under 35 U.S.C. 154(b) by 67 days.

(21) Appl. No.: 17/329,584

(22) Filed: May 25, 2021

(65) Prior Publication Data

US 2022/0205249 A1 Jun. 30, 2022

(30) Foreign Application Priority Data

Dec. 24, 2020 (TW) ..... 109217039

(51) Int. Cl.
*E04F 11/18* (2006.01)
*A47K 17/02* (2006.01)

(52) U.S. Cl.
CPC ..... *E04F 11/1808* (2013.01); *A47K 17/022* (2013.01); *E04F 11/1804* (2013.01)

(58) Field of Classification Search
CPC ..... E04F 11/1808; E04F 11/1804; A47K 17/022; A47K 3/003; A47K 2201/02
USPC ..... 248/251; 4/576.1
See application file for complete search history.

(56) References Cited

U.S. PATENT DOCUMENTS 4,289,303 A * 9/1981 Hamm ..... E04F 11/1808 256/69
7,107,651 B1 9/2006 Lin
7,967,522 B2 * 6/2011 Goad ..... E04F 11/1808 403/205
2008/0078904 A1 * 4/2008 Trimble ..... E04F 11/1804 248/251
2008/0098510 A1 * 5/2008 O'Brien ..... A47K 17/022 4/576.1
2009/0205124 A1 8/2009 Forrest et al.
2009/0211017 A1 * 8/2009 Bowden ..... A47K 17/022 248/251
2009/0308995 A1 * 12/2009 Kuo ..... A47K 10/10 248/231.91
2011/0239365 A1 * 10/2011 Grant ..... A47K 3/003 4/576.1
2011/0253854 A1 * 10/2011 Garrels ..... A47K 17/022 29/525.01
2020/0102753 A1 * 4/2020 Holland ..... F21V 31/005
2020/0270869 A1 * 8/2020 Chuang ..... F21V 23/0471

OTHER PUBLICATIONS

International Search Report issued by Foreign Patent Office for Counterpart Application No. 21177388.2 dated Nov. 3, 2021.

* cited by examiner

*Primary Examiner* — Muhammad Ijaz
(74) *Attorney, Agent, or Firm* — Rosenberg, Klein & Lee

(57) ABSTRACT

A safety handle device includes a handle tube unit, a plurality of joint members, and a plurality of support tube units. The handle tube unit is formed with a tube channel that has two openings, and has a plurality of mounting holes. Each joint member is detachably disposed in the tube channel and has an engaging bore. Each support tube unit includes a support tube subunit detachably coupled to the handle tube unit, a fastening member passing through the respective mounting hole and engaged detachably with the engaging bore of the respective joint member, a securing seat adapted to be fixed to a wall, and a securing member extending into the support tube subunit and connected to the securing seat.

10 Claims, 11 Drawing Sheets

SAFETY HANDLE DEVICE

CROSS-REFERENCE TO RELATED APPLICATIONS

This application claims priority of Taiwanese Utility Model Patent Application No. 109217039, filed on Dec. 24, 2020.

FIELD

The disclosure relates to an assistive device, more particularly to a safety handle device.

BACKGROUND

Referring to FIG. 1, in order to improve safety of bathroom, a safety handle 1 is commonly installed in the wall of bathroom to assist safe bathing for the elderly or people with mobility impairments. The safety handle 1 has a U-shaped tubing 11 and two fixture members respectively connected to opposite ends of the tubing 11. The tubing 11 can be installed on the wall through the fixture members 12.

The tubing 11 is integrally formed by metal casting. In order to enhance visual appearance, the tubing 11 needs to undergo a time-consuming surface polishing process. However, due to the bulky size of the tubing 11, the manufacturing costs of the safety handle 1 is relatively high.

SUMMARY

Therefore, the object of the disclosure is to provide a safety handle device that can save manufacturing time and reduce manufacturing costs.

According to the disclosure, a safety handle device is adapted to be installed on a wall. The safety handle device includes a handle tube unit, a plurality of joint members, and a plurality of support tube units.

The handle tube unit is adapted to be disposed at a spacing from the wall, and is formed with a tube channel that extends along an axis of the handle tube unit, and that has two openings opposite along the axis of the handle tube unit. The handle tube unit has a plurality of mounting holes that is in communication with the tube channel.

The joint members correspond respectively in position to the mounting holes and are detachably disposed in the tube channel of the handle tube unit. Each joint member has an engaging bore that is in alignment and communication with the respective mounting hole.

The support tube units are joined to the joint members respectively and are coupled detachably to the handle tube unit. Each support tube unit includes a support tube subunit, a fastening member, a securing seat, and a securing member. The support tube subunit is in aligned with a respective mounting hole and is detachably coupled to an outer surface of the handle tube unit. The fastening member passes from an interior of the support tube subunit through the respective mounting hole of the handle tube unit, is engaged detachably with the engaging bore of the respective joint member. The securing seat is adapted to be fixed to the wall and is connected to the support tube subunit. The securing member extends detachably into the support tube subunit and is connected detachably to the securing seat.

For each support tube unit, the support tube subunit has a pedestal connected to the securing seat, a support tube welded to the pedestal and extending to the handle tube unit, and an insert piece disposed in the interior of and welded to the support tube. The fastening member passes through the insert piece.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
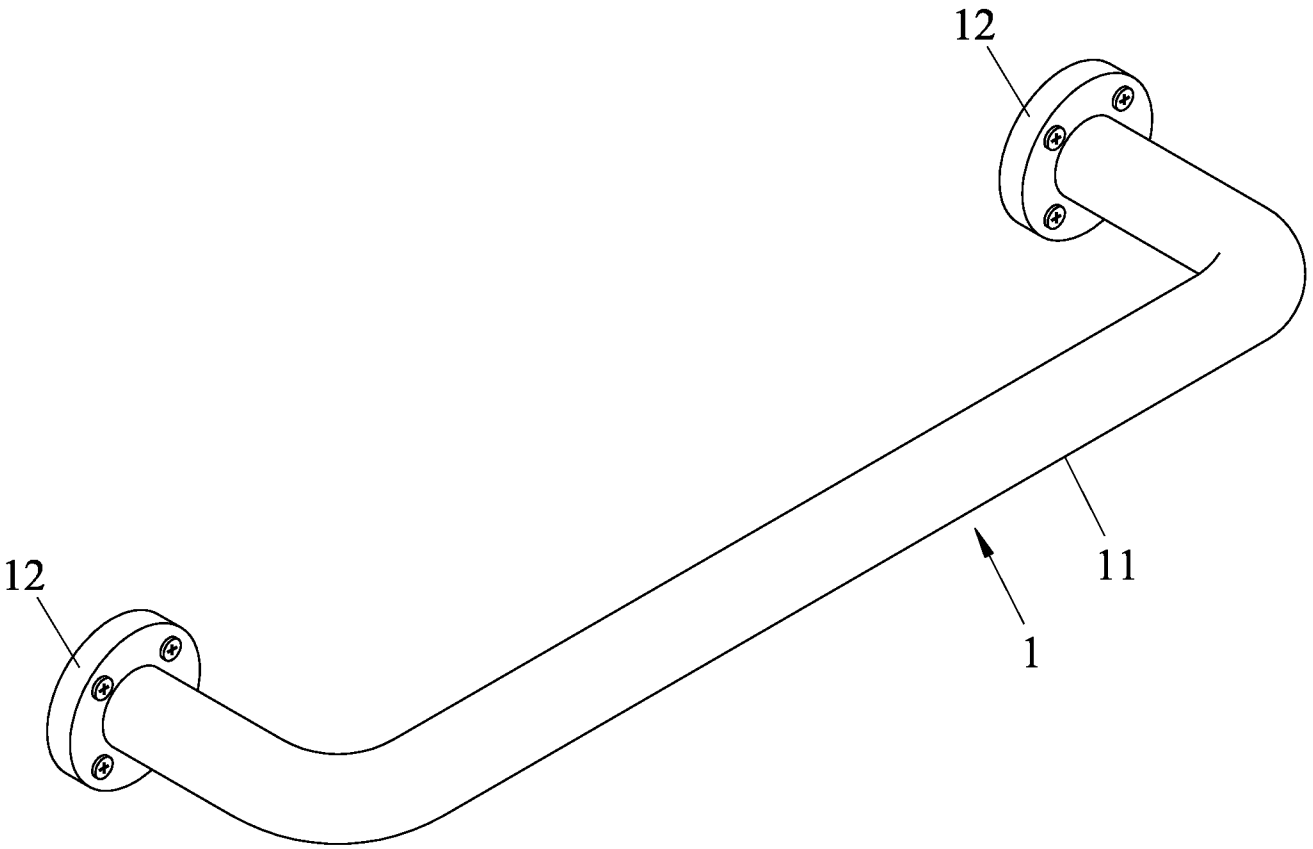
FIG.1 PRIOR ART
FIG. 1 is a perspective view of an existing safety handle.

Before the present invention is described in greater detail, it should be noted that where considered appropriate, reference numerals or terminal portions of reference numerals have been repeated among the figures to indicate corresponding or analogous elements, which may optionally have similar characteristics.

Figure 2:
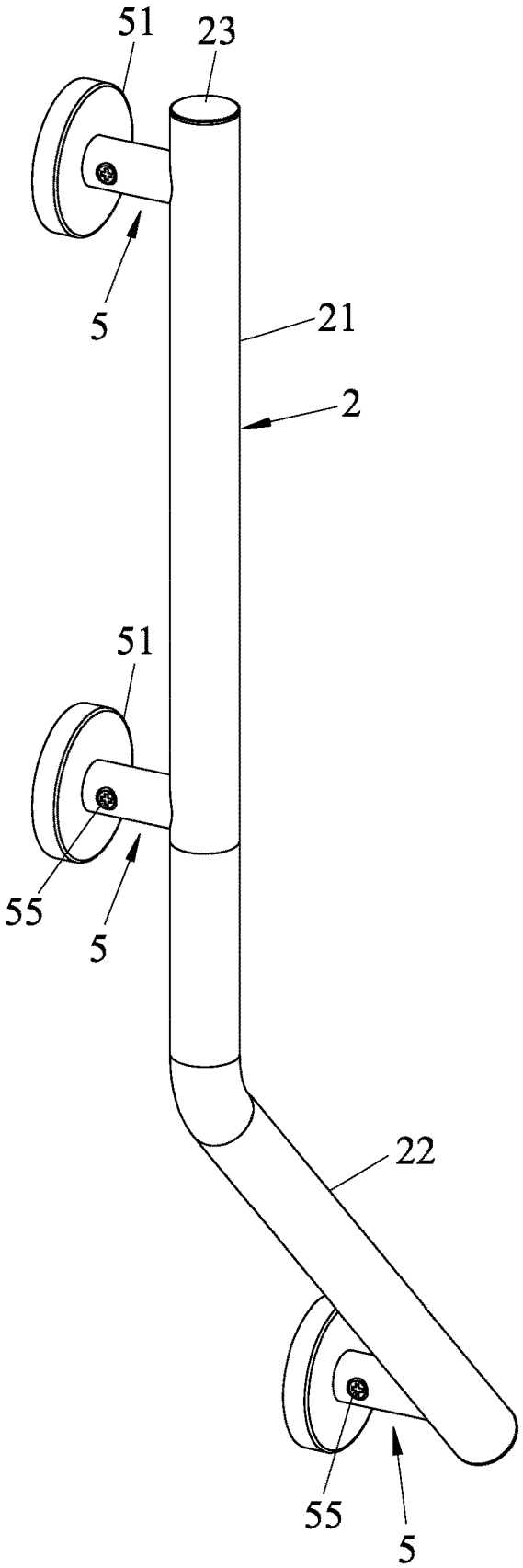
FIG. 2 is a perspective view of the first embodiment of the safety handle device according to the disclosure.
Figure 3:
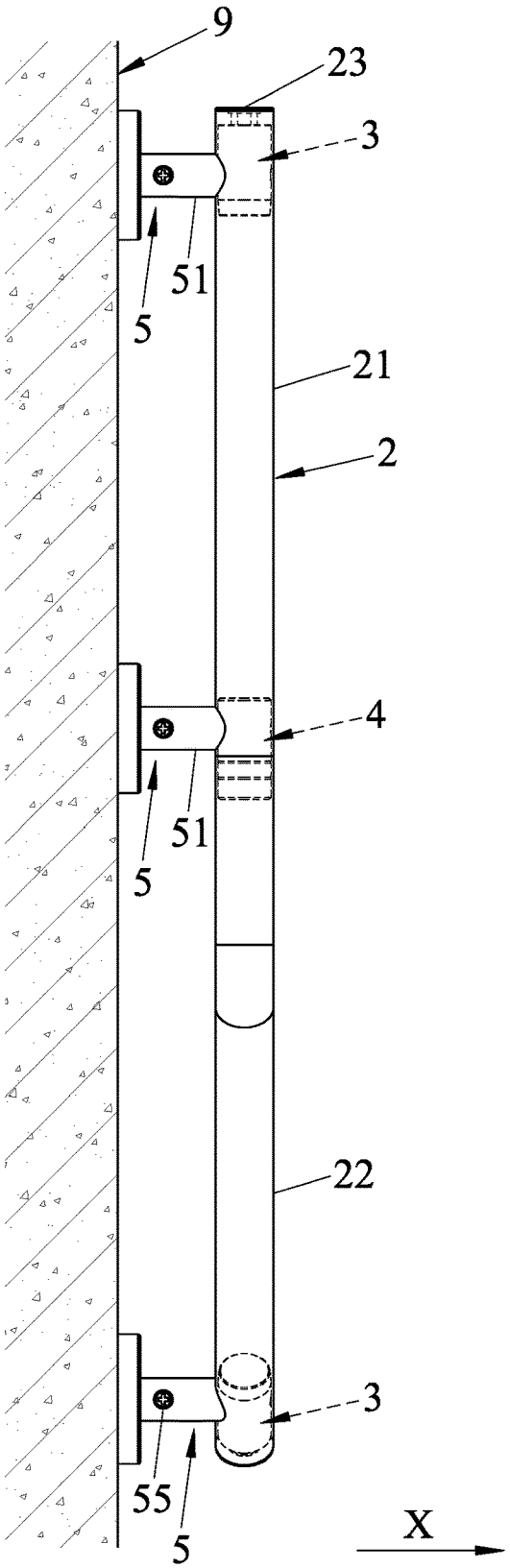
FIG. 3 is a schematic side view of the first embodiment installed on a wall.

As shown in FIGS. 2 and 3, the first embodiment of the safety handle device according to the present disclosure is adapted to be installed on a wall 9. The wall 9 is described by the example of a bathroom wall, but the wall 9 actually may be a wall or partition in any place. The safety handle device includes a handle tube unit 2, two first joint members 3, a second joint member 4 and three support tube units 5.

Figure 4:
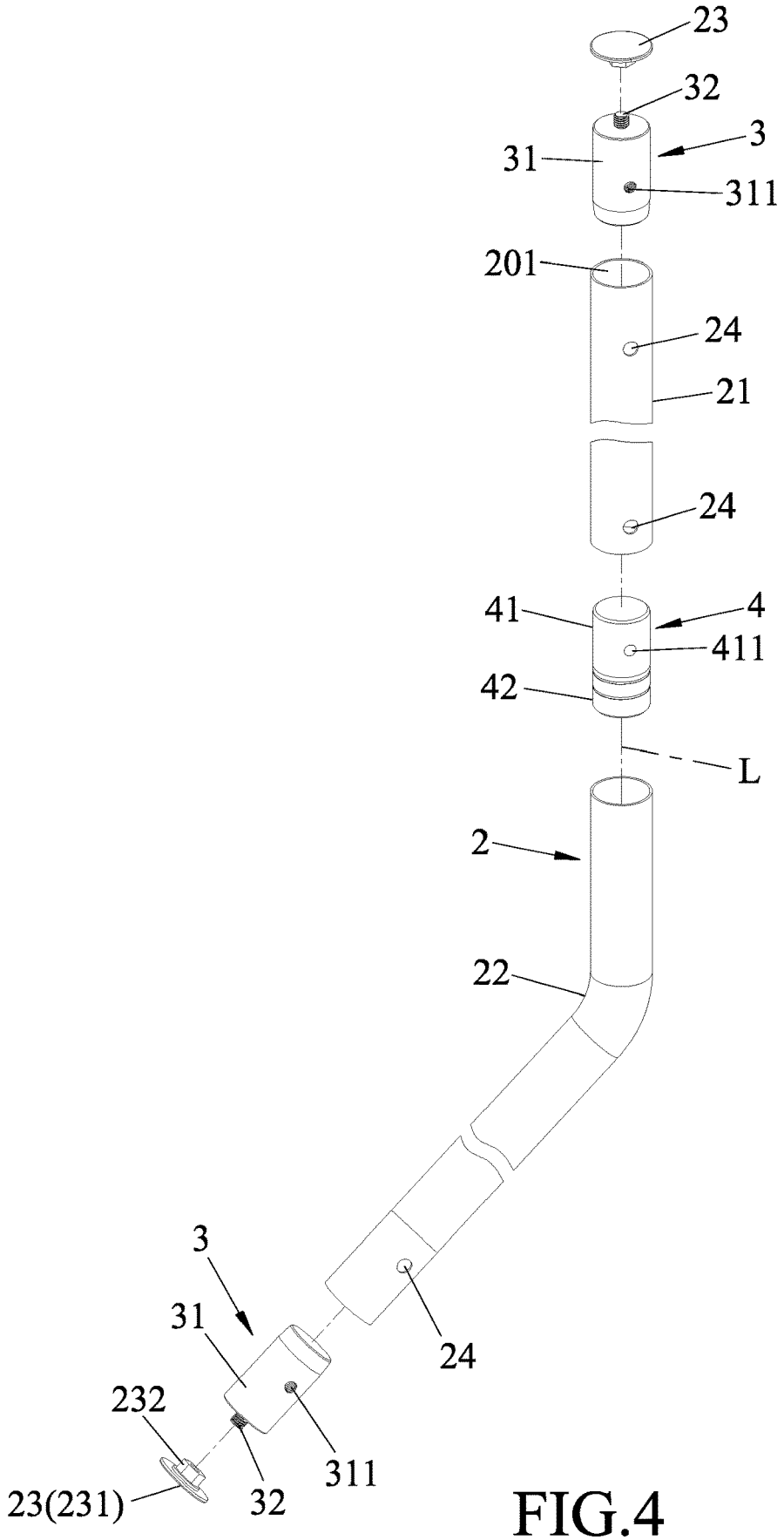
FIG. 4 is a fragmentary exploded perspective view of the first embodiment.
Figure 5:
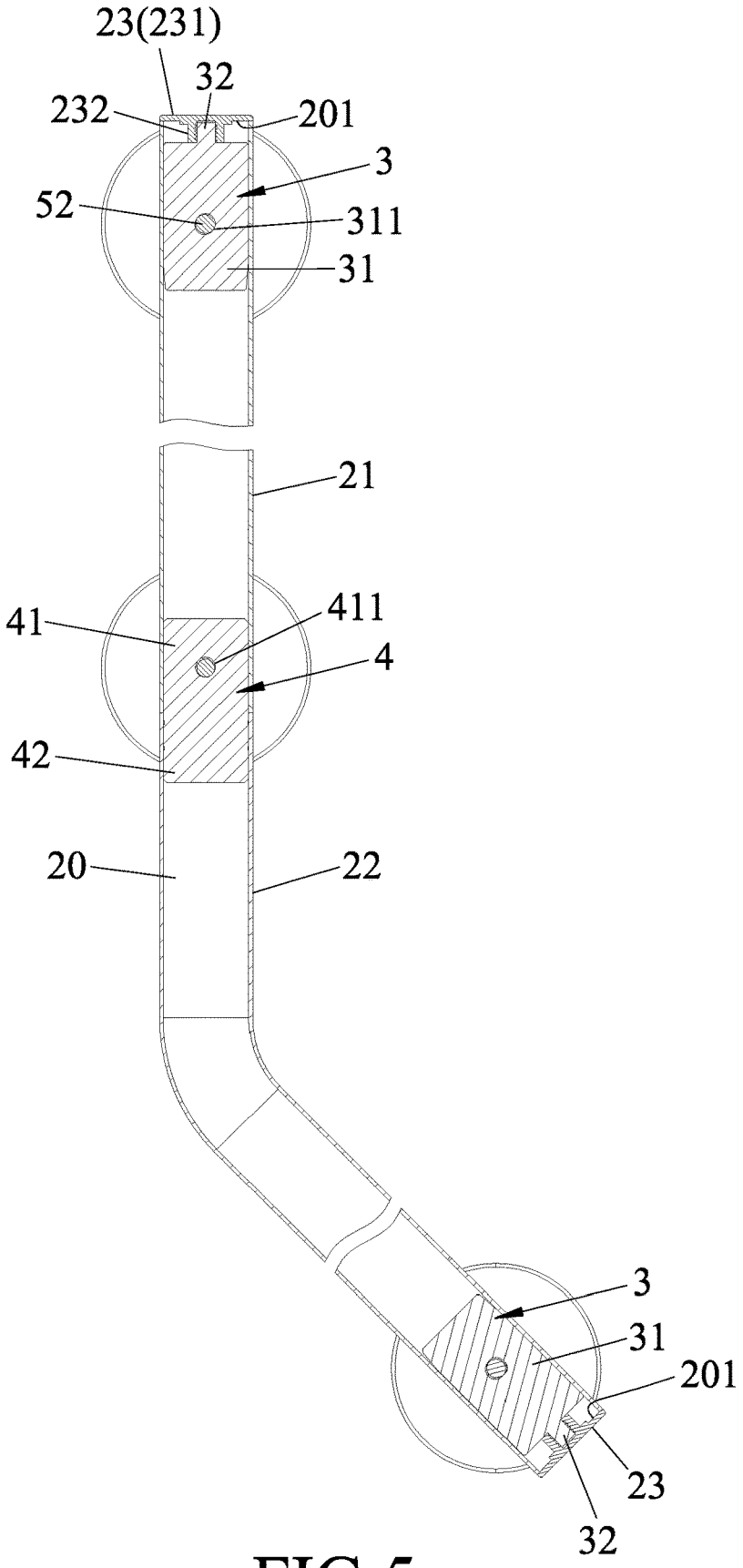
FIG. 5 is a fragmentary cross-sectional view of the first embodiment.

Referring to FIGS. 3 to 5, the handle tube unit 2 is adapted to be disposed at a spacing from the wall 9. The handle tube unit 2 of the first embodiment includes a first tube member 21, a second tube member 22 detachably connected with the first tube member 21, and two end caps 23. The first tube member 21 and the second tube member 23 are formed with a tube channel 20 that extends along an axis (L) of the handle tube unit 2. The tube channel 20 has two openings 201 at the opposite ends along the axis (L) of the handle unit 2. The two end caps 23 are disposed detachably and respectively at the openings 201 and close the openings 201 respectively. Each end cap 23 has a cover portion 231 shielding the respective opening 201, and a protruding portion 232 protruding from the cover portion 231 into the tube channel 20, and provided with a threaded bore. The first tubular members 21 is a straight tube, and the second tube member 22 is a bent tube. However the second tube member 22 may also be a straight tube, or the first tube member 21 may also be a bent tube, it depends on the requirements of installation.

The first tube member 21 has three mounting holes 24. Two of the mounting holes 24 are formed respectively in opposite ends of the first tube member 21 and communicate with the tube channel 20, and the remainder one of the mounting holes 24 is formed in and end of the second tube member 22 and communicate with the tube channel 20. The combination of the first tube member 21 and the second tube member 22 provides a lengthened handle tube unit 2, or provides a bending portion of the handle tube unit 2 as required for installation. It should be understood that when there is a need for greater length or more bending portions of the handle tube unit 2, the handle tube unit 2 may include a combination of more first tube members 21 and second tube members 22 and thus additional mounting holes 24 are provided in this handle tube unit 2. The wall thickness of the first tube member 21 and the second tube member 22 is between 1.0 mm and 1.5 mm, and is 1.35 mm in this embodiment. By increasing the wall thickness, the structural strength of the first tube member 21 and the second tube member 22 can be improved and the load-bearing capacity is in turn increased.

Figure 6:
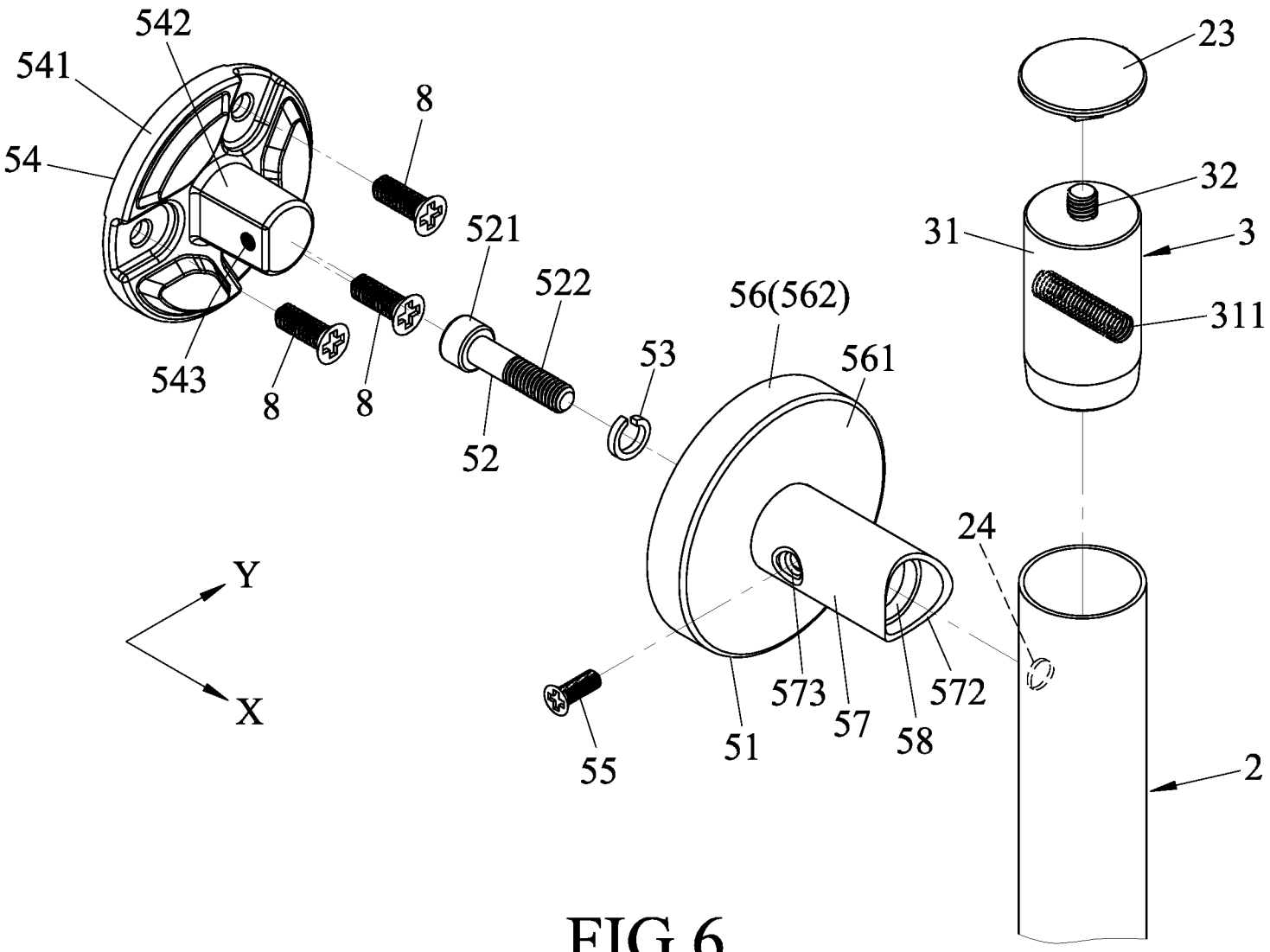
FIG. 6 is a fragmentary exploded perspective view of a handle unit, a support tube unit and a first joint member of the first embodiment.

Referring to FIGS. 4 to 6, the first joint members 3 and the second joint member 4 correspond respectively in position to the mounting holes 24 and are detachably disposed in the tube channel 20 of the handle tube unit 2. The two first joint members 3 are plugged in the first tubular member 21 and the second tubular member 22 respectively, and proximate to the two openings 201 of the tube channel 20 respectively. The two end caps 23 are fastened to the two first joint members 3 respectively. The second joint member 4 is plugged in the first tube member 21 and the second tube member 22 to thereby interconnect them. Each first joint member 3 includes a body part 31 detachably disposed in the tube channel 20, and a threaded stud 32 extending from the body part 31 toward a respective opening 201 and threadedly engaged with a respective end cap 23. The body part 31 is formed with an engaging bore 311 that is in alignment and communicated with the respective mounting hole 24, and that is a threaded through-hole. The second joint member 4 has a structure similar to the body part 31 of the first joint member 3. The second joint member 4 has a joint section 41 disposed in the first tube member 21 and an insert section 42 disposed in the second tube member 22. One of the joint section 41 and the insert section 42 is formed with an engaging bore 411. In this embodiment, the engaging bore 411 is formed in the joint section 41.

Referring to FIGS. 3 and 6, the three support tube units 5 are respectively joined to the two first joint members 3 and the second joint member 4, and are detachably coupled to the handle tube unit 2. Each support tube unit 5 includes a support tube subunit 51 extending in a first direction (X) and connected to the handle tube unit 2, a fastening member 52 disposed in the support tube subunit 51 and engaged with the respective engaging bore 311, 411, a washer 53 pressed between the fastening member 52 and the support tube subunit 51, a securing seat 54 connected with the support tube subunit 51 and adapted to be fixed to the wall 9, and a securing member 55 threaded into the support tube subunit 51 in a second direction (Y) which is substantially perpendicular to the first direction (X) and connected to the securing seat 54. In the first embodiment, the fastening member 52 is a bolt which has a head 521 and a shank 522 extending from the head 521 in the first direction (X), and the securing member 55 is a screw.

Figure 7:
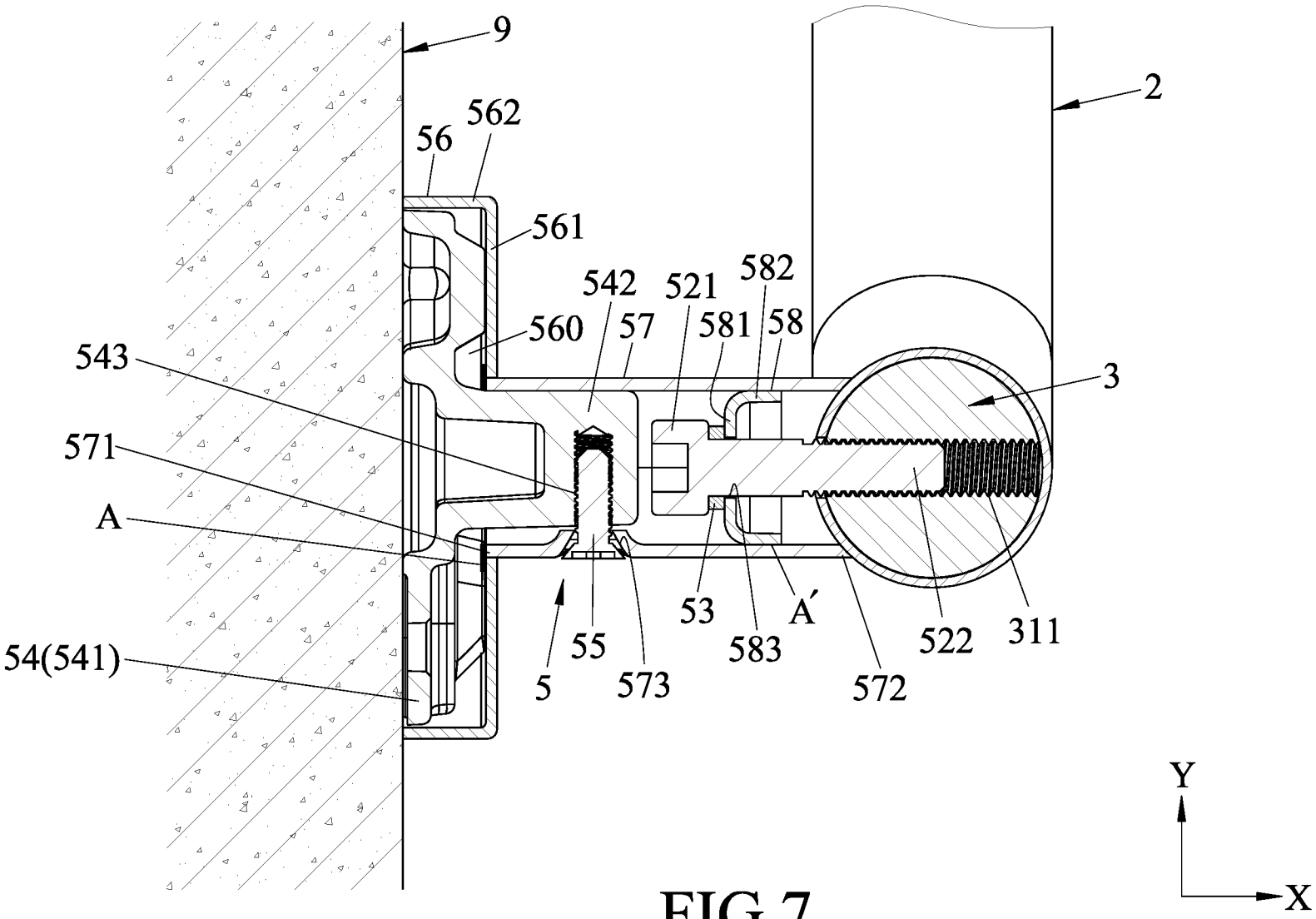
FIG. 7 is a fragmentary cross-sectional view of the first embodiment installed on the wall.
Figure 8:
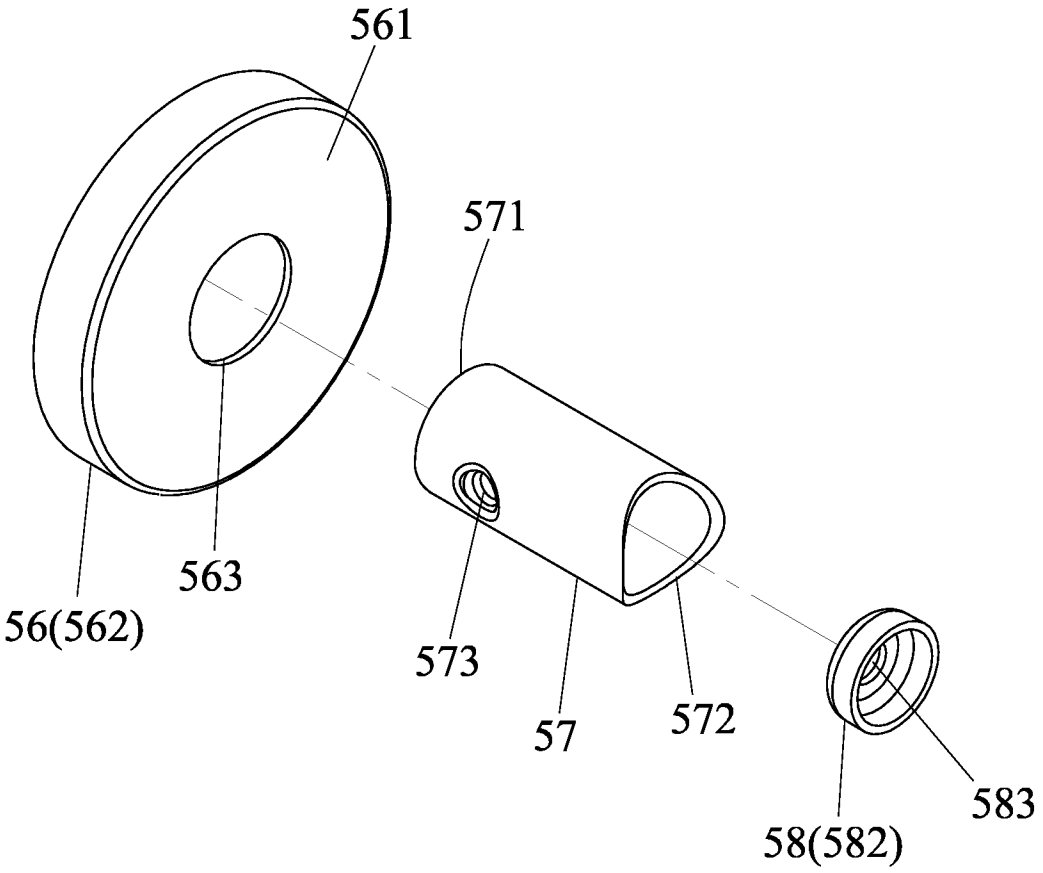
FIG. 8 is an exploded perspective view of the support tube unit of the first embodiment.

Referring to FIGS. 6 to 8, for each support tube unit 5, the support tube subunit 51 is aligned with a respective mounting hole 24 and detachably coupled to an outer surface of the handle tube unit 2. It is noted that the description will be made hereinafter with reference only one support tube unit 5. The support tube subunit 51 has a pedestal 56 connected to the securing seat 54, a support tube 57 extending from the pedestal 56 to the handle tube unit 2 in the first direction (X) and connected with the pedestal 56 by plasma welding, and an insert piece 58 fixed inside of the support tube by laser welding and provided for holding the fastening member 52. The pedestal 56 has a base wall 561 and a surrounding wall 562 surrounding the base wall 561 and extending from a periphery of the base wall 561 away from the support tube 57. The base wall 561 and the surrounding wall 562 cooperatively form an accommodating groove 560 that accommodates the securing seat 54. The base wall 561 has a through hole 563 communicated with the accommodating groove 560. The support tube 57 has a fixed end 571 extending through the base wall opening 563 and welded to the base wall 561, a contoured end 572 opposite to the fixed end 571 in the first direction (X) and coupled to the exterior of the handle tube unit 2, and a perforation 573 formed between the contoured end 572 and the fixed end 571. The fixed end 571 and the pedestal 56 are welded at an intersection (A) which is between the fixed end 571 and the base wall 561 of the pedestal 56 and which is located in the accommodating groove 560. The contoured end 572 is shaped in conformity with the outer contour of the handle tube unit 2. The insert piece 58 is disposed in the interior of the support tube 57 and welded to the support tube 57. The insert piece 58 has an end wall 581 and a peripheral wall 582 surrounding the end wall 581 and extending from the end wall 581 toward the handle tube unit 2. The end wall 581 has an aperture 583 through which the fastening member 52 passes. The insert piece 58 is welded to the support tube 57 at an interconnection (A') which is between the peripheral wall 582 of the insert piece 58 and the support tube 57. In the first embodiment, since the contoured end 572 is conformed in shape to the outer wall of the handle tube unit 2, and the welding positions (i.e., the intersection (A) between the pedestal 56 and the support tube 57, and the interconnection (A') between the insert piece 58 and the support tube 57) is concealed, the overall structural appearance is more aesthetically pleasing. The wall thickness of the support tube 57 and the pedestal 56 is between 1.0 mm and 1.5 mm, and is 1.35 mm in this embodiment. With a greater wall thickness, the structural strength of the support tube 57 and the pedestal 56 can be improved and the load-bearing capacity is in turn increased.

The fastening member 52 passes from the interior of the support tube 57 through, in the first direction (X), the aperture 583 of the insert piece 58 and the respective mounting hole 24 of the handle tube unit 2, and is engaged detachably with the engaging bore 311 of the respective first and second joint members 3, 4. The washer 53 is pressed between the head 521 of the fastening member 52 and the end wall 581 of the insert piece 58. As such, the support tube unit 5 is fixed to the handle tube unit 2.

The securing seat 54 is adapted to be fixed to the wall 9 by a plurality of screws 8 and is connected to the support tube subunit 51. The securing seat 54 has a main seat body 541 adapted to be fixed to the wall 9 and accommodated in the accommodating groove 560 of the pedestal 56, and a rod body 542 extending from the main seat body 541 in the first direction (X) into the support tube 57. The rod body 542 has a fastening hole 543 extending in the second direction (Y).

The securing member 55 extends detachably into the support tube 57 through the perforation 573 of the support tube 57, and is threadedly engaged with the fastening hole 543 of the securing seat 54, thereby fixing the support tube subunit 51 to the securing seat 54.

Referring to FIGS. 3 and 7, during the installation of the present disclosure, the support tube subunits 51 of the support tube units 5 are first joined to the handle tube unit 2, then the securing seats 54 are fixed to the wall 9, and finally the support tube subunits 51 are joined to the securing seats 54 respectively.

According to the present disclosure, the safety handle device is broken down to the handle tube unit 2, the first and second joint members 3, 4, and the support tube units 5. The support tube subunit 51 of each support tube unit 5 is composed of a plurality of components fixed together by welding, and the first joint members 3 and the second joint member 4 are used to connect the support tube units 5 to the handle tube unit 2. Therefore, the components of the safety handle device of the present disclosure can be made from tubing or sheet metal through the techniques such as stamping, shearing, turning-milling, or bending. Compared with the conventional safety handle manufactured as an integral by casting which entails a time-consuming surface polishing process, the manufacturing time and cost can be reduced since the relative small components are easier to process. In addition, in the first embodiment, the configuration that the welding positions (A, A') of each support tube subunit 51 are concealed makes the visual appearance more aesthetically pleasing.

It is worth mentioning that, in the first embodiment, the combination of the first tube member 21 and the second tube member 22 provides a handle tube unit 2 with greater length or required bending portion, and through an arrangement of the mounting holes 24 on the handle tube unit 2 at appropriate spacing determined by the length thereof for connection of the support tube units 5, a desired load-bearing capacity of the safety handle device can be maintained. Therefore, the length of the handle tube unit 2 of the first embodiment can be considerably increased to enable wider applicability. In addition, in the first embodiment, the wall thickness of the first tube member 21, the second tube member 22, and the support tube 57 and the pedestal 56 of each support tube unit 5 can be as large as 1.0-1.5 mm such that the load-bearing capacity of the safety handle device can be more than 200 kg.

Figure 9:
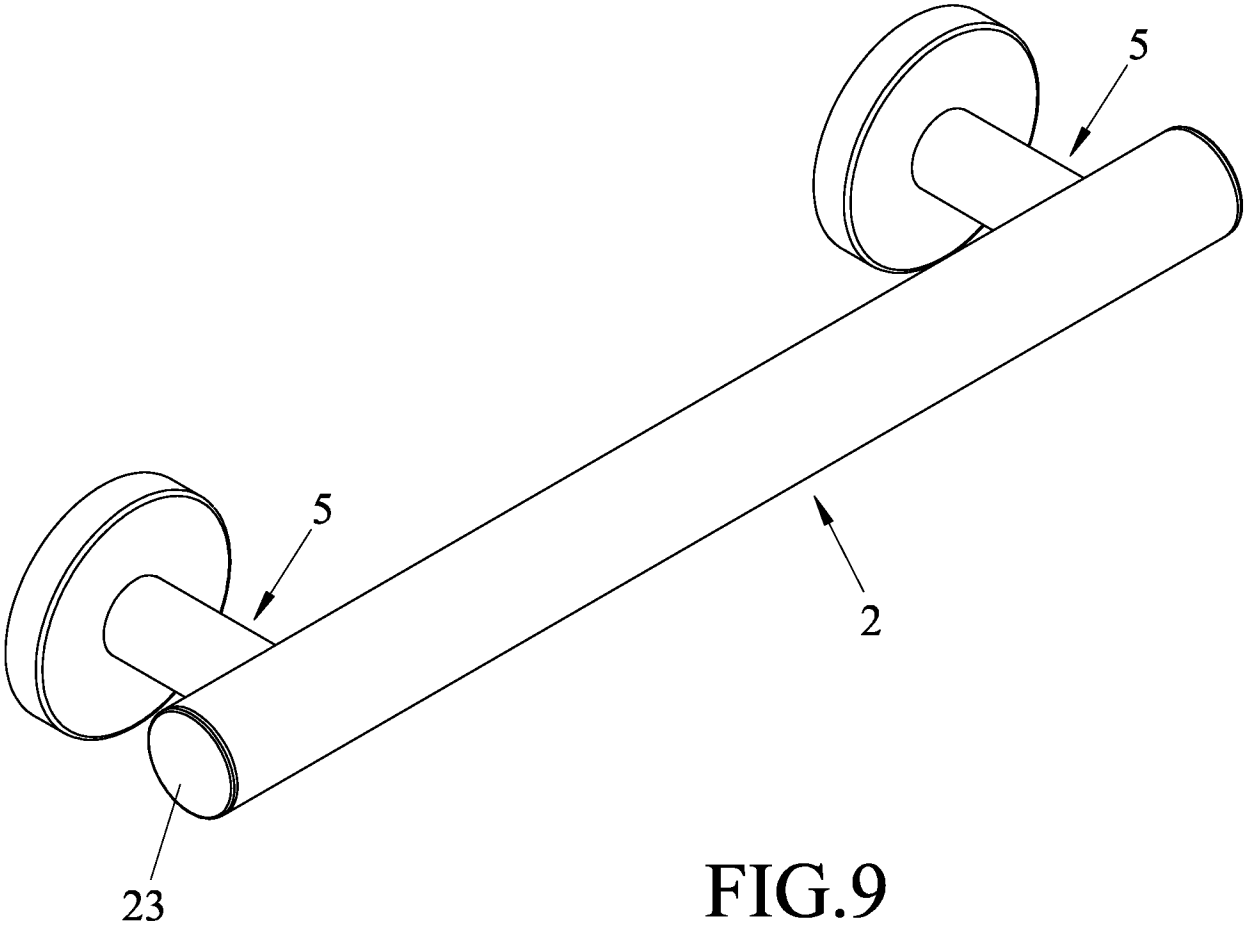
FIG. 9 is a perspective view of the second embodiment of the safety handle device according to the disclosure.
Figure 10:
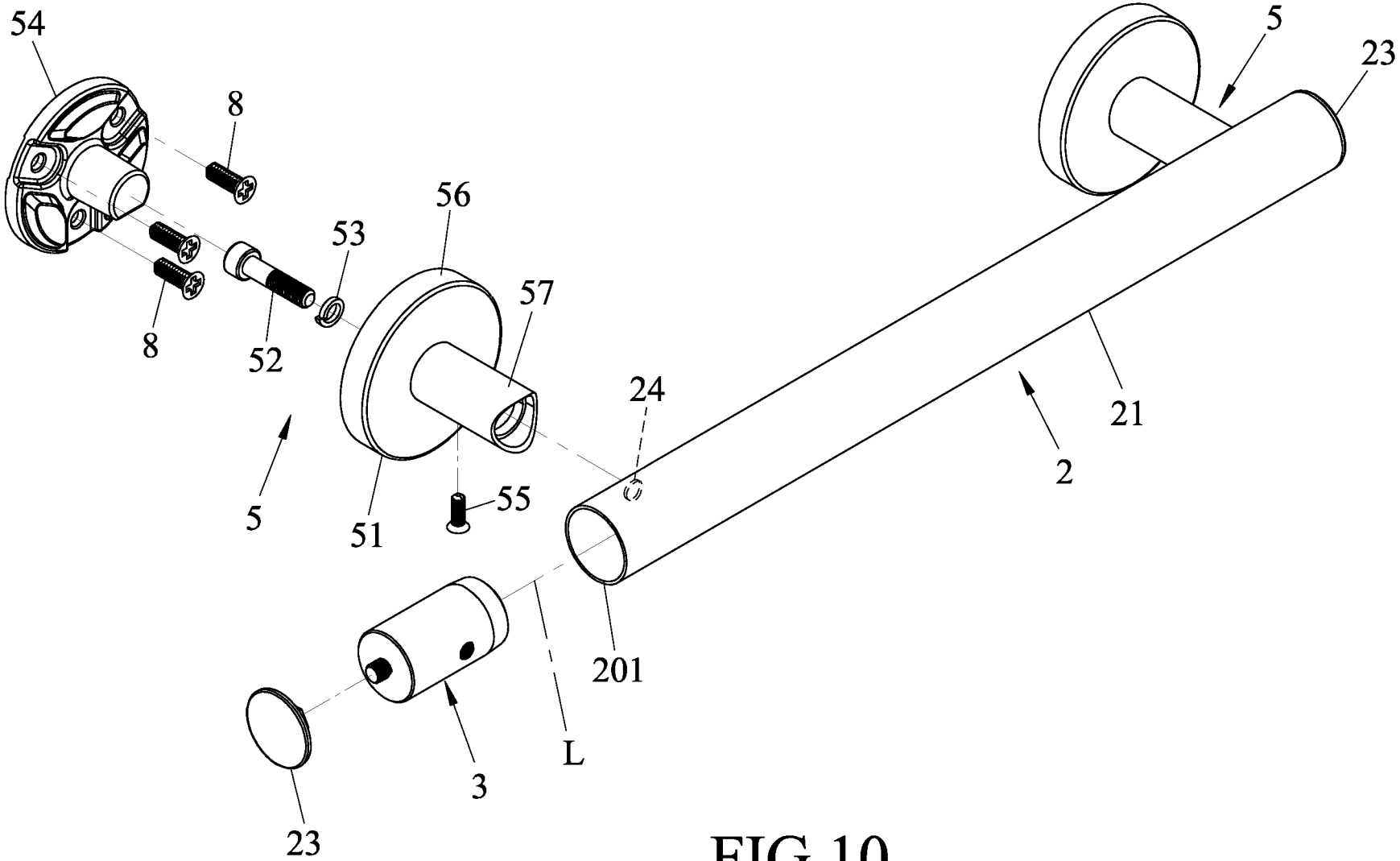
FIG. 10 is a partly exploded perspective view of the second embodiment.
Figure 11:
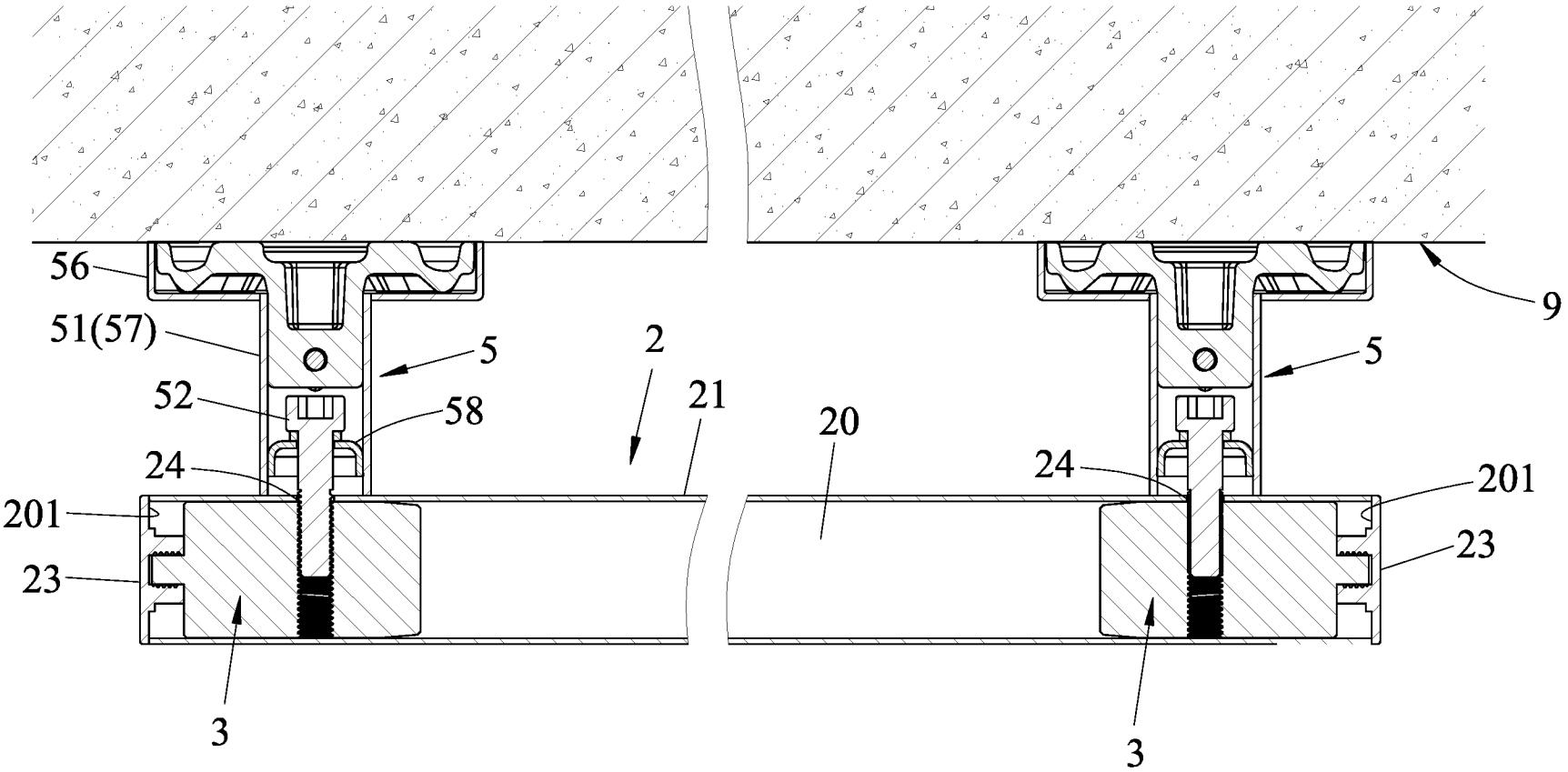
FIG. 11 is a fragmentary cross-sectional view of the second embodiment installed on the wall.

Referring to FIGS. 9 to 11, the second embodiment of the safety handle device of the present disclosure is shown. The second embodiment is similar to the first embodiment, and the main difference resides in the following.

The safety handle device in the second embodiment includes a handle tube unit 2, two first joint members 3, and two support tube units 5.

The handle tube unit 2 includes a first tube member 21 and two end covers 23. The first tube member 21 is formed with the tube channel 20 having two openings 201, and two mounting holes 24.

The two first joint members 3 are detachably disposed in the tube channel 20 of the handle tube unit 2, and the two support tube units 5 are detachably joined to the first tube member 21 through the two first joint member 3. This embodiment is similar to the first embodiment in that the detachable joining of the support tube units 5 and the handle tube unit 2. The second embodiment provides a safety handle device for safety assistance in a narrow space.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A safety handle device adapted to be installed on a wall, said safety handle device comprising:

a handle tube unit adapted to be disposed at a spacing from the wall and formed with a tube channel that extends along an axis of said handle tube unit, and that has two openings opposite along the axis of said handle tube unit, said handle tube unit having a plurality of mounting holes that are in communication with said tube channel;

a plurality of joint members being respectively positioned in correspondence to said plurality of mounting holes and detachably disposed in said tube channel of said handle tube unit, each joint member having an engaging bore that is in alignment and communication with a corresponding one of said plurality of mounting holes; and a plurality of support tube units joined to said joint members respectively and coupled detachably to said handle tube unit, each support tube unit including a support tube subunit, a fastening member, a securing seat, and a securing member, said support tube subunit being in aligned with a respective mounting hole and detachably coupled to an outer surface of said handle tube unit, said fastening member passing from an interior of said support tube subunit through the respective mounting hole of said handle tube unit and engaged detachably with said engaging bore of the respective joint member, said securing seat being adapted to be fixed to the wall and connected to said support tube subunit, said securing member extending detachably into said support tube subunit and connected detachably to said securing seat;

wherein, for each support tube unit, said support tube subunit has a pedestal connected to said securing seat, a support tube welded to said pedestal and extending to said handle tube unit, and an insert piece disposed in the interior of and welded to said support tube, said fastening member passing through said insert piece.

2. The safety handle device as claimed in claim 1, wherein, for each support tube unit, said pedestal of said support tube subunit has a base wall and a surrounding wall surrounding said base wall and extending from said base wall in a direction away from said support tube, said base wall and said surrounding wall cooperatively forming an accommodating groove that accommodates said securing seat, said support tube and said pedestal being welded at an intersection that is located in said accommodating groove.

3. The safety handle device as claimed in claim 1, wherein, for each support tube unit, said insert piece of said support tube subunit has an end wall, and a peripheral wall surrounding said end wall and extending from said end wall toward said handle tube unit, said end wall having an aperture through which said fastening member passes, said peripheral wall being welded to said support tube.

4. The safety handle device as claimed in claim 1, wherein, for each support tube unit:

said support tube has a perforation;

said securing seat has a seat body adapted to be fixed to the wall, and a rod body extending from said seat body in a first direction into said support tube;

said rod body has a fastening hole extending in a second direction that is substantially perpendicular to the first direction; and said securing member extends through said perforation and is engaged with said fastening hole.

5. The safety handle device as claimed in claim 4, wherein, for each support tube unit, said support tube further has a fixed end connected to said pedestal, and a contoured end opposite to said fixed end in the first direction, said contoured end is shaped in conformity with an exterior of said handle tube unit.

6. The safety handle device as claimed in claim 1, wherein:

for each support tube unit, said fastening member has a head and a shank extending from said head in a first direction and engaged detachably with said engaging bore of the respective joint member; and each support unit further includes a washer that is pressed between said head of said fastening member and said insert piece.

7. The safety handle device as claimed in claim 1, wherein:

said handle tube unit includes a first tube member that is formed with said tube channel and said two openings;

said plurality of mounting holes include two mounting holes formed in said first tube member;

said plurality of joint members include two joint members; and said plurality of support tube units include two support tube units.

8. The safety handle device as claimed in claim 7, wherein:

said handle tube unit further includes two end caps closing said two openings respectively;

each joint member has a body part detachably disposed in said tube channel and formed with said engaging bore, and a threaded stud extending from said body part toward a corresponding one of said two openings and threadedly engaged with a respective end cap.

9. The safety handle device as claimed in claim 1, wherein:

said handle tube unit includes a first tube member and a second tube member detachably connected with said first tube member, said first tube member and said second tube member being formed with said tube channel and said two openings;

said plurality of mounting holes include three mounting holes formed in said first and second tube members;

said plurality of joint members include three joint members;

said plurality of support tube units include three support tube units; and one of said three joint members interconnects said first tube member and second tube member.

10. The safety handle device as claimed in claim 9, wherein:

said handle tube unit further includes two end caps closing said two openings respectively;

said three joint members include two first joint members proximate to said two openings respectively, and a second joint member interconnecting said first tube member and said second tube member;

each first joint member has a body part detachably disposed in said tube channel and formed with said engaging bore, and a threaded stud extending from said body part toward a corresponding one of said two openings and threadedly engaged with a respective end cap; and said second joint member has a joint section disposed in said first tube member and an insert section disposed in said second tube member, one of said joint section and said insert section being formed with said engaging bore.

* * * * *